United States Patent [19]

Wayt

[11] 4,332,296

[45] Jun. 1, 1982

[54] WELL CLEANING TOOL

[76] Inventor: Newell E. Wayt, 2272 Dominguez St., Torrance, Calif. 90501

[21] Appl. No.: 174,676

[22] Filed: Aug. 1, 1980

[51] Int. Cl.[3] ..... B08B 9/02; E21B 37/02

[52] U.S. Cl. ..... 166/171; 166/173

[58] Field of Search ..... 15/104.08, 104.09, 104.16, 15/104.18; 166/171, 170, 173

[56] References Cited

U.S. PATENT DOCUMENTS

| | | | |
|---|---|---|---|
| 438,964 | 10/1890 | Watson | 15/104.16 |
| 915,584 | 3/1909 | Frazee | 15/104.08 |
| 2,224,412 | 12/1940 | Smith | 15/104.16 X |
| 2,826,077 | 3/1958 | Walker | 15/104.18 X |
| 4,031,590 | 6/1977 | Clavin | 15/104.18 X |
| 4,067,386 | 1/1978 | Weise | 166/255 X |

*Primary Examiner*—Stephen J. Novosad
*Assistant Examiner*—Joseph Falk
*Attorney, Agent, or Firm*—Georges A. Maxwell

[57] ABSTRACT

A liner cleaning tooling comprising an elongate vertically extending cylindrical body, coupling means at the upper end of the body to connect with a fluid conducting run-in pipe string, a central longitudinal flow passage in the body communicating with the pipe string and opening downwardly, an enlarged, central, axially extending cylindrical chamber in the body between the upper and lower end portions of the flow passage, a plurality of circumferentially spaced ball receiving openings in the body communicating between the exterior of the body and the chamber, an elongate axially shiftable mandrel with a downward and radially inwardly convergent conical surface slidably engaged in the chamber and having a central longitudinal fluid conducting opening, a helical compression spring in the chamber above the mandrel and engaging and normally yieldingly urging the mandrel downwardly and a ball rotatably and axially shiftably arranged in each opening and having an outer liner engaging portion projecting radially outwardly from the body and an inner portion projecting radially inwardly into the chamber and engaging the mandrel.

8 Claims, 4 Drawing Figures

WELL CLEANING TOOL

This invention has to do with a well tool and is more particularly concerned with a tool for cleaning scale and the like from the interior of well casings, liners and production tubing.

In the oil production art, the interiors of well casings, perforated liners and like tubular elements become caked with rust, petroleum sludge and with chemical scale to such an extent that operation and production of the wells is impaired.

When casings and liners become excessively fouled and/or plugged with scale and the like, it is common practice to remove the production tubing, with the pump and its operating means related to it from the well and to lower a suitable cleaning tool into the casing and/or liner by means of a run-in string and to operate said string and tool to effect cleaning the interior of the casing and/or liner.

Typical of such cleaning tools are wire brush type units commonly referred to as scratchers and which involve a tubular fluid conducting body engageable on the lower end of a fluid conducting run-in string and having a plurality of longitudinally and radially spaced substantially radially outwardly projecting spring wire bristles. Such tools are run into the well structure and are rotated and reciprocated in the well to scratch and thereby to remove scale and the like from the interior of the casing and/or liner. Fluid is pumped down through the string, through the tool and into the well structure to circulate up through the well, about the exterior of the tool and run-in string and to flush and carry away the materials freed by the tool.

Liners are ordinarily provided with round perforations or with slot-like openings to permit radial inward flow of production into the liners. Scratcher tools of the general character referred to are designed so that the ends of the wire bristles will enter the openings or slots in the liners to clean or remove scale and the like therefrom.

All too frequently, particularly in well structures which have been let to become heavily encrusted with scale and the like, scratcher type tools simply scratch the scale, removing soft, loose surface materials, but do not remove the scale itself.

Further, when the openings in a liner become excessively or completely plugged with scale and the like, the wire bristles of the ordinary scratcher tool will not enter the openings and such tools are completely ineffective.

One other tool for cleaning casings and liners which has met with some success and which overcomes certain of the noted shortcomings of wire scratcher tools is a roller type cleaner tool. This type of tool consists of an elongate fluid conducting body engageable on the lower end of a fluid conducting run-in string and which carries a pair of circumferentially spaced elongate longitudinally upwardly and radially outwardly inclined casing and/or liner engaging rollers. The lower ends of the rollers occur wholly within the inside gauge of the casings or liners and within the anticipated inside surface of the scale deposit; while the upper end of the rollers are at the inner gauge of the casings and/or liners. By lowering and rotating such a tool into a well structure and circulating fluid through the run-in string and tool, the rollers mill and crush the scale and the fluid flushes it away. The principal shortcomings to be found in such roller type cleaning tools resides in the fact that the inclined rollers tend to create an inclined seat in the scale and upon which they tend to run. Due to the excessive surface contact established between the rollers and such a seat established in the scale, considerable and oftentimes excessive forces must be exerted through the tool and onto the shoulder established by the tool, with the result that the rollers lock or freeze in the well structure and excessive torsional forces are exerted upon the well structure which result in twisting and/or distorting the liners and/or casings. Such twisting and distortion of the parts of the well structure can be anticipated in old wells where the liners and casings are rusted thin. Accordingly, the use of such roller type cleaning tools is extremely limited.

Further, such roller type cleaning tools are not considered safe to run in old wells or wells where a portion of the casing or liner might be slightly crushed or collapsed. If such a condition exists, these tapered tools will freely move downwardly by the collapsed portion, but are very apt to catch and hang up on the collapsed portion when it is attempted to withdraw the tool from the well.

Still further, such roller type tools have little or no effect for cleaning the openings in liners and at best may displace some scale from such openings by urging the crushed materials removed from the inside wall of the liners outwardly through the opening.

An object and feature of my invention is to provide an improved well casing and/or liner cleaning tool which tool includes a plurality of circumferentially spaced casing and/or liner engaging balls and means to releasably urge the balls radially outwardly beyond the inside gauge of the liner or casing to an extent less than the modulus of elasticity of the steel from which the casing or liner is established whereby the tool controllably flexes the wall of the casing or liner at and along the lines of contact between the balls and the casing or liner whereby rust and scale on the inside surface of the casing or liner is freed from the casing or liner and is readily reduced and displaced by the balls.

It is an object and feature of the present invention to provide a tool of the general character referred to in which the balls are arranged in circumferentially spaced radially outwardly disposed openings in an elongate body for free limited radial shifting and are engaged by a common, central, vertically shiftable spring loaded tapered mandrel in the body which mandrel normally yieldingly urges the balls radially outward.

It is a further object of my invention to provide a tool of the character referred having means to limit and control downward shifting of the mandrel and resulting outward movement of the balls.

Still another object of my invention is to provide a tool of the character referred which is such that it can be moved and operated in an upward direction equally as well as in a downward direction in a well structure and is not subject to being caught and hung up on restrictions that might occur in a well structure.

It is a further object of the present invention to provide a tool of the character referred to wherein the body is provided with a central longitudinal flow passage having an upper end communicating with a related fluid handling run-in string and a lower end communicating with the interior of the well structure, an enlarged chamber intermediate the ends of the flow passage to slidably receive the mandrel and a central flow passage in the mandrel to freely conduct fluid flowing through the body.

It is a feature of the present invention to provide a tool of the character referred to wherein the radial outward forces exerted onto and through the balls is restricted to point contact between the balls and their related casing or liner whereby the spring pressure required to urge the mandrel downwardly and the balls radially outwardly to gain the desired function of the tool need not be excessive.

Finally, it is an object of the present invention to provide a tool of the character referred to which is extremely simple, compact, rugged and durable and a tool which is highly effective and dependable in operation.

The foregoing and other objects and features of my invention will be fully understood from the following detailed description of a typical preferred form and embodiment of my invention, throughout which description reference is made to the accompanying drawings in which.

Figure 1:
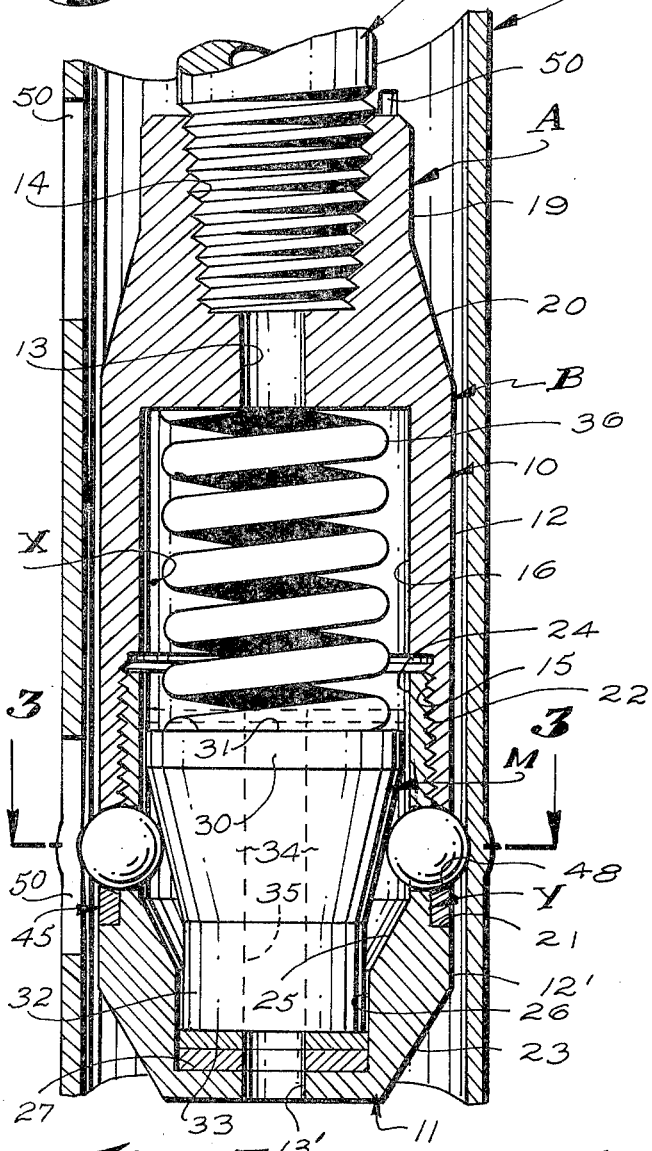
FIG. 1 is a longitudinal central view of my new tool in operative position in a well structure.
Figure 2:
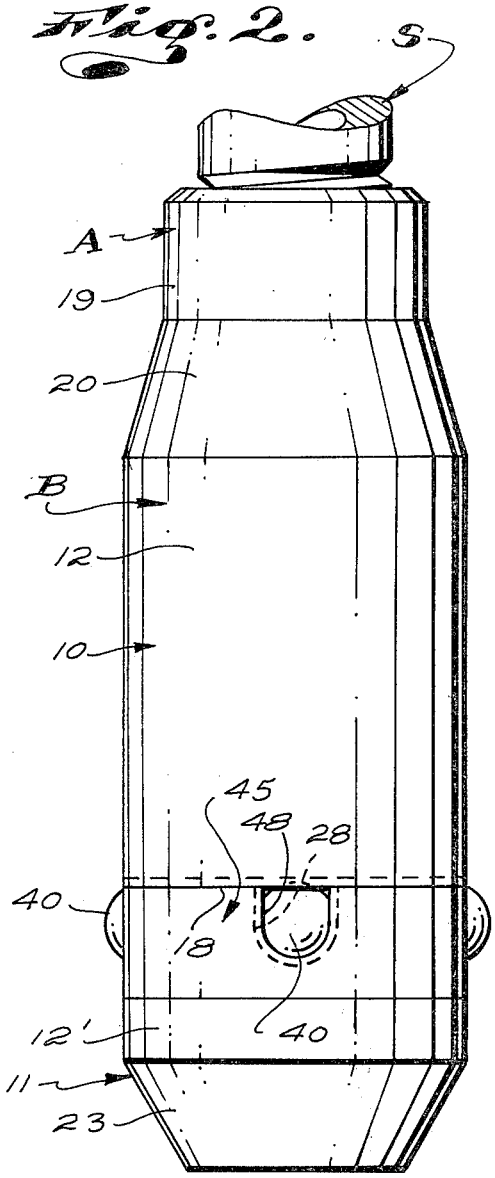
FIG. 2 is an elevational view of the structure shown in FIG. 1.

The tool A that I provide includes an elongate sectional body B having an upper section 10 and a lower section 11.

The upper section 10 is an elongate vertically extending unitary part having a cylindrical outer surface 12, a central flow passage 13, an upwardly opening threaded socket or box 14 entering the upper end of the section to communicate with the flow passage 13 and in which the lower end of a fluid conducting run-in string of pipe S is engaged, a downwardly opening threaded socket 15 entering the lower end of the section and a cylindrical counter bore or socket 16 continuing upwardly in the body from the socket 15, concentric with and communicating with the flow passage 13 and terminating in the section to define a flat downwardly disposed annular stop shoulder 17, about the lower end of the flow passage.

The lower annular end of the section 10 is inclined radially inwardly and upwardly to define an annular seat 18.

The major diameter of the section 10 defines an outer surface 12 and is sufficiently smaller than the inside diameter of the casing or liner with which the tool is to be related so that the tool can and will pass or move freely longitudinally into and through the casing or liner L.

In the preferred carrying out of the invention and as illustrated in the drawings, the upper end of the section 10, in which the box 14 occurs, is of reduced diametric extent, as indicated at 19 and that portion of the section between the upper reduced portion 19 and that portion in which the sockets 15 and 16 occur and which define the surface 12 is tapered radially inwardly and upwardly to define an upwardly convergent, conical, guide surface 20 which surface serves to guide the tool by obstructions and the like that might occur in the well structure when the tool is withdrawn or pulled upwardly through a related well structure and upon which the tool might otherwise catch and become hung up.

The lower section 11 of the body B is an elongate vertically extending unitary section corresponding in major outside diametric extent with the section 10 and defining a cylindrical outer surface 12'.

The upper end portion of the section 10 is reduced in outside diametric extent to define an upwardly projecting annular stop shoulder 21. The upper portion of the reduced upper end portion of said section is externally threaded as at 22 and is threadedly engaged in the socket 15 in the section 10.

When the lower section is engaged in the upper section in the manner set forth above and as illustrated in the drawings, the shoulder 21 occurs in axial spaced relationship below and opposes the annular downwardly and inwardly disposed seat 18 defined by the lower end of the upper section 10. It will be apparent that the shoulder 21 and seat 18 and that portion of the section 11 extending therebetween define an annular outwardly opening channel Y about the exterior of the body, intermediate the ends thereof.

The lower portion of the section 11 is downwardly and radially inclined to define a downwardly convergent conical guide surface 23 to facilitate guiding the tool downwardly into a well structure and by or past any obstructions that might occur in said well structure.

The section 11 further includes a central longitudinal flow passage 13' opening at the bottom end of the section and a central cylindrical socket or bore 24 entering the upper end of the section and terminating at a downwardly and radially inwardly inclined bottom 25 and a counter bore or guide bore 26 continuing downwardly from the bottom 25 of the bore 24, communicating with the flow passage 13' and terminating in the section to define a flat upwardly disposed annular stop shoulder 27.

In addition to the foregoing, the section 11 is provided with a plurality (4) of circumferentially spaced, round, radially extending ball receiving openings 28 occurring in the upper reduced portion of the section 11 and between the shoulder 21 and the threads 23, and communicating with the bore 24 and the channel Y.

The bore 24 corresponds in diametric extent and is in direct communication with the socket 16 in the section 10.

With the structure thus far described it will be apparent that the body considered as a unit is an elongate cylindrical unit having a central longitudinal flow passage, defined by the passages 13 and 13', a central longitudinally extending cylindrical chamber X defined by the socket 16 and bore 24 and arranged concentric with and intermediate the ends of the flow passage, a downwardly disposed stop shoulder at the upper end of the chamber, a guide bore 26 of reduced diameter at the lower end of the chamber X, an annular radially outwardly opening channel Y in the exterior of the body and circumferentially spaced, radially outwardly opening ball receiving openings 28 communicating with the lower end of the chamber X and the channel Y.

The body is further provided with upwardly and downwardly convergent conical guide surfaces at its upper and lower ends and has coupling means at its upper end to connect and communicate with the lower end of a fluid conducting run-in string of pipe.

In addition to the foregoing, my new tool includes an elongate cylindrical mandrel M having an enlarged upper portion 30 with a flat top 31, a smaller lower portion 32 with a flat bottom 33 and a downwardly and radially inwardly inclined central conical portion 34 between the upper and lower portions and defining an inclined cam surface.

The mandrel is further provided with a central longitudinal flow passage 35, corresponding in diametric extent or preferably somewhat larger than the flow passages 13 and 13' in the body B.

The mandrel M is arranged in the body B with its upper portion 30 slidably engaged in the chamber X, with its top 31 opposing and in spaced relationship below the stop shoulder 17 at the upper end of said chamber. The lower end portion 32 of the mandrel enters and is slidably engaged in the guide bore 26 with its bottom 33 opposing and in spaced relationship above the bottom 27 of the bore. The central concial portion of the mandrel occurs in the lower portion of the chamber X and radially inward of the ball receiving openings 28.

The construction that I provide further includes an elongate helical compression spring 36 in the chamber X between the stop shoulder 17 and the top 31 of the mandrel M to normally yieldingly urge the mandrel downwardly in the construction.

Still further, the construction includes one or more annular spacer rings 37 in the guide bore between the bottom 27 of said bore and the bottom 33 of the mandrel M to limit or stop downward movement of the mandrel.

In practice, the rings 37 can be dispensed with and the bottom 33 of the mandrel can stop directly on the bottom 27 of the bore 26.

The tool construction further includes a plurality (4) of liner and/or casing engaging balls 40, each being slidably engaged in one of the openings 28 in the body B. The balls 40 are hardened steel ball bearings and are considerably greater in diametric extent than the wall thickness of the tool between the bore of the chamber X and the exterior of the body and so that they project radially outwardly from the exterior of the body and project radially inwardly into the chamber X. The radial inner portion of the balls projecting into the chamber X establish bearing engagement on the central conical or cam portion 34 of the mandrel and are subject to being shifted radially outwardly by downward shifting of the mandrel in the body, by action of the compression spring 36. Still further, radial inward shifting of the balls causes upward shifting of the mandrel M against the resistance of the spring 36.

The outer portions of the balls 40 projecting outwardly from the body are adapted to engage the inner surface or bore of the casing or liner L and are urged outwardly into pressure engagement therewith by action of the spring 36 and cam or cone portion of the mandrel M.

To prevent excessive radial outward shifting and displacement of the balls 40, the lower section 11 of the body is advanced into the upper section 10 so that the upper sides of the openings 28 occur in the same radial plane as the upper inner edge of the annular seat 19 defined by the lower end of the section 10 and so that the inclined seat 18 projects downwardly and outwardly to overlie the upper portion of each of the openings 28. With such a relationship of parts, the upper outer portion of the balls 40 engage the seat 18 upon maximum desired outward shifting thereof and displacement of said balls from engagement in the openings 28 is thereby prevented.

Since the radial outward forces exerted onto and through the balls 40 by the spring and mandrel is considerable and the seat 18 is apt not to withstand those forces, I further provide a keeper sleeve or ring 45 engaged in the channel Y and with the balls 40.

The sleeve 45 is an annular metal sleeve corresponding in outside diametric extent with the surface 12, in inside diametric extent and in axial extent with the channel Y. The lower end 46 of the sleeve seats on the shoulder 21 and the upper end 47 thereof is upwardly and inwardly inclined and cooperatively seats with the seat 18.

The sleeve 45 is provided with a plurality (4) of circumferentially spaced upwardly and radially inwardly and outwardly opening notches 48 each adapted to register with one of the openings 28.

Each notch 48 has a radius or round bottom portion and straight vertically extending upper portions. The edges of the lower round portions of the notches are concentric with their related openings 28 and are radially inwardly and axially outwardly inclined relative to the axis of their related openings 28. The major diametric extent of each notch is equal to the diametric extent of its related openings.

With the above relationship of parts, it will be apparent that the round inclined edge portion of the notches establish inclined stop surfaces 48 about and overlying the outer edges of the openings 28 about the lower halves thereof and serve to limit and stop excessive radial outward shifting and displacement of the balls 40 from the construction.

It will be apparent that the seat 18 and the stop surfaces 48 cooperate to establish sufficient stop means to prevent radial outward displacement of the balls.

It will be further apparent that the provision of the sleeve 45 greatly simplifies manufacture of the construction and makes possible easy assembly of said construction.

In operation, the tool is engaged on the lower end of the run-in string S, is lowered into a related well structure and into the liner L which is to be cleaned. When the tool is thus arranged, the string S and tool A are rotated. The balls 40 being urged radially outwardly by the spring and mandrel establish pressure rolling engagement on the interior surface of the liner L.

The pressure exerted onto the liner L by the balls is sufficient to stretch the metal from which the liner is established and in such a manner as to cause the scale on the surfaces of the liner to be freed therefrom by shearing forces.

Excessive stretching of the liner, beyond the modulus of elasticity of the metal of which it is established is prevented by limiting the downward movement of the mandrel in the body. This can be effected by establishing the bottom 33 of the mandrel M and the bottom of the guide bore 26 in a predetermined relationship whereby the mandrel bottoms and stops in the body at a predetermined position or by means of the stop rings arranged in the body. It will be apparent that by using the stop rings, considerable variation and adjustment of the action of the tool can be advantageously obtained.

As the tool is rotated, as set forth above, it is also moved longitudinally upwardly and/or downwardly in the liner L and so that the balls mill and crush the scale and the like in the liner.

Figure 3:
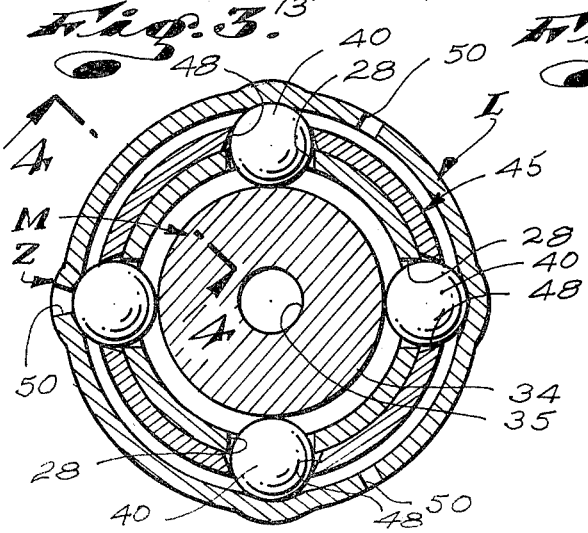
FIG. 3 is a sectional view taken as indicated by line 3—3 on FIG. 1.
Figure 4:
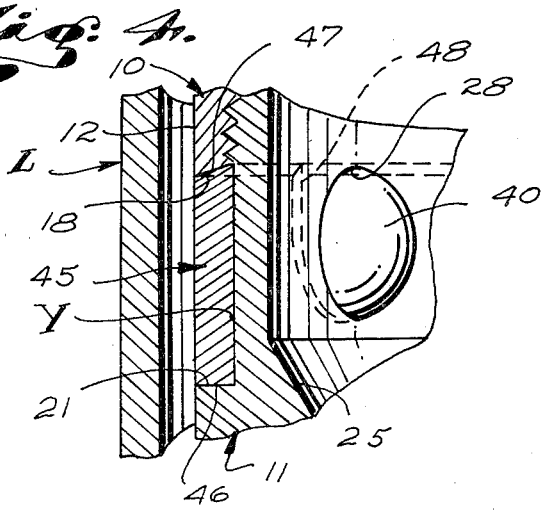
FIG. 4 is an enlarged detailed sectional view taken substantially as indicated by line 4—4 on FIG. 3.

It is to be noted that with my new tool, scale on the exterior of the liner is also freed, as indicated at Z, in phantom lines, in FIG. 3 of the drawings.

It will be further apparent that as my tool is operated in the manner set forth above, it tends to flex the slot-like openings 50 in the liner L open, freeing scale which might plug the slots and making radial outward displacement of such scale, by fluid under pressure and by other material urged through the slots of the liner, by the tool, possible.

During operation of the tool, fluid is circulated downwardly through the pipe string S and tool into the well structure to flush the material freed by the tool from said well structure.

In the event that the tool must be urged by or past a restriction or obstruction in the well structure, or by a tool joint or the like, which will not permit outward shifting of the balls, the inclined guide surfaces 20 and 23 of the body wedge such obstructions radially outwardly a sufficient extent to permit the passage of the tool. In such a case, if the inner surface of the liner is in bearing contact with the exterior of the tool or is in closer than anticipated proximity to the tool than was anticipated, the balls are urged radially inwardly against the yielding resistance of the spring and mandrel.

Accordingly, the tool that I provide is such that it is not subject to becoming caught or hung up in a serviceable well structure or such that it cannot be operated in a serviceable well structure. By serviceable well structure, I mean to include any well structure which may have certain limited obstructions therein, but do not mean to include well structures that have completely collapsed or are so blocked by major obstructions as to be rendered unserviceable.

In practice, many small or minor bends, dents or collapsed portions of a liner are effectively rolled out by the action of my tool.

While it is not the intended function of my new tool to straighten and open collapsed liners and the like, it will be apparent that the tool does effect such a function in an exceptionally effective and efficient manner.

Having described only a typical preferred form and application of my invention, I do not wish to be limited or restricted to the specific details herein set forth, but wish to reserve to myself any modifications and/or variations which may appear to those skilled in the art and which fall within the scope of the following claims:

Having described my invention, I claim:

1. A liner cleaning tool comprising an elongate vertically extending cylindrical body, coupling means at the upper end of the body to connect with a fluid conducting run-in pipe string, a central longitudinal flow passage in the body communicating with the pipe string and opening downwardly, an enlarged, central, axially extending cylindrical chamber in the body between the upper and lower end portions of the flow passage, a plurality of circumferentially spaced ball receiving openings in the body communicating between the exterior of the body and the chamber, an elongate axially shiftable mandrel with a downward and radially inwardly convergent conical surface slidably engaged in the chamber and having a central longitudinal fluid conducting opening, a helical compression spring in the chamber above the mandrel and engaging and normally yieldingly urging the mandrel downwardly and a ball rotatably and axially shiftably arranged in each opening and having an outer liner engaging portion projecting radially outwardly from the body and an inner portion projecting radially inwardly into the chamber and engaging the mandrel.

2. A structure as set forth in claim 1 wherein the upper end portion of the body has a radially inwardly and upwardly inclined guide surface and the lower portion of the body has a radially inwardly and downwardly inclined guide surface.

3. A structure as set forth in claim 1 wherein said body has an axial guide bore continuing downwardly from the lower end of the chamber and terminating as a flat bottom, said mandrel has a cylindrical extension with a flat bottom end at the lower end slidably engaged in said bore and an annular spacer ring at the bottom of the bore to be engaged by and to limit downward movement of the mandrel.

4. A structure as set forth in claim 1 wherein the upper end portion of the body has a radially inwardly and upwardly inclined guide surface and the lower portion of the body has a radially inwardly and downwardly inclined guide surface, said body has an axial guide bore continuing downwardly from the lower end of the chamber and terminating at a flat bottom, said mandrel has a cylindrical extension with a flat bottom end at the lower end slidably engaged in said bore and an annular spacer ring at the bottom of the bore to be engaged by and to limit downward movement of the mandrel.

5. A structure as set forth in claim 1 including radially inwardly and axially outwardly inclined stop surfaces about the outer ends of the ball receiving openings to stop and limit radial outward shifting of the balls.

6. A structure as set forth in claim 1 wherein the upper end portion of the body has a radially inwardly and upwardly inclined guide surface and the lower portion of the body has a radially inwardly and downwardly inclined guide surface, radially inwardly and axially outwardly inclined stop surfaces about the outer ends of the ball receiving openings to stop and limit radial outward shifting of the balls.

7. A structure as set forth in claim 1 wherein said body has an axial guide bore continuing downwardly from the lower end of the chamber and terminating at a flat bottom, said mandrel has a cylindrical extension with a flat bottom end at the lower end slidably engaged in said bore and an annular spacer ring at the bottom of the bore to be engaged by and to limit downward movement of the mandrel, radially inwardly and axially outwardly inclined stop surfaces about the outer ends of the ball receiving openings to stop and limit radial outward shifting of the balls.

8. A structure as set forth in claim 1 wherein the upper end portion of the body has a radially inwardly and upwardly inclined guide surface and the lower portion of the body has a radially inwardly and downwardly inclined guide surface, said body has an axial guide bore continuing downwardly from the lower end of the chamber and terminating at a flat bottom, said mandrel has a cylindrical extension with a flat bottom end at the lower end slidably engaged in said bore and an annular spacer ring at the bottom of the bore to be engaged by and to limit downward movement of the mandrel, radially inwardly and axially outwardly inclined stop surfaces about the outer ends of the ball receiving openings to stop and limit radial outward shifting of the balls.

* * * * *